United States Patent [19]

Kimura et al.

[11] Patent Number: 4,905,754

[45] Date of Patent: Mar. 6, 1990

[54] FOOTROLL ASSEMBLY FOR A CONTINUOUS CASTING APPARATUS

[75] Inventors: Takashi Kimura, Stevensville; Teruyoshi Hirose, St. Joseph, both of Mich.

[73] Assignee: Sumitec, Inc., Benton Harbor, Mich.

[21] Appl. No.: 316,518

[22] Filed: Feb. 28, 1989

[51] Int. Cl.[4] ..... B22D 11/04; B22D 11/12

[52] U.S. Cl. ..... 164/442; 164/448

[58] Field of Search ..... 164/442, 448, 444

[56] References Cited

U.S. PATENT DOCUMENTS

| | | | |
|---|---|---|---|
| 2,770,021 | 11/1956 | Harter, Jr. et al. | 164/442 X |
| 2,895,190 | 7/1959 | Bungeroth et al. | 164/448 X |
| 2,988,790 | 6/1961 | Rustemeyer et al. . | |
| 3,015,862 | 1/1962 | Rustemeyer et al. . | |
| 3,263,284 | 8/1966 | Orr et al. | 164/448 X |
| 3,314,115 | 4/1967 | Saunders et al. | 164/448 |
| 3,370,642 | 2/1968 | Meier et al. . | |
| 3,430,684 | 3/1969 | Babel et al. . | |
| 3,559,719 | 2/1971 | Rossi | 164/442 |
| 3,735,848 | 5/1973 | Bode, Jr. et al. | 164/448 |
| 4,056,140 | 11/1977 | Ives et al. | 164/448 X |
| 4,090,549 | 5/1978 | Ives et al. | 164/442 X |
| 4,256,169 | 3/1981 | Ives | 164/448 |
| 4,300,619 | 11/1981 | Scheurecker | 164/442 X |
| 4,479,529 | 10/1984 | Scheurecker | 164/442 |
| 4,488,591 | 12/1984 | Hoffmann et al. | 164/442 |
| 4,590,986 | 5/1986 | Scholz et al. | 164/448 |
| 4,669,526 | 6/1987 | Hury | 164/442 X |
| 4,685,506 | 8/1987 | Fasano | 164/442 X |

FOREIGN PATENT DOCUMENTS

| | | | |
|---|---|---|---|
| 395439 | 7/1965 | Switzerland | 164/448 |
| 582045 | 12/1977 | U.S.S.R. | 164/442 |
| 1118451 | 7/1968 | United Kingdom | 164/448 |
| 1158172 | 7/1969 | United Kingdom | 164/448 |

*Primary Examiner*—Nicholas P. Godici
*Assistant Examiner*—J. Reed Batten, Jr.
*Attorney, Agent, or Firm*—Jeffers, Hoffman & Niewyk

[57] ABSTRACT

The footroll assembly includes a plurality of rollers each of which is resiliently mounted within a frame member. The entire frame member is adjustable toward or away from the slab which is cast in the mold. The frame is rigidly but adjustably secured to the mold assembly.

16 Claims, 2 Drawing Sheets

FOOTROLL ASSEMBLY FOR A CONTINUOUS CASTING APPARATUS

BACKGROUND OF THE INVENTION

This invention relates to footroll assemblies for continuous casting machines, and in particular to a footroll assembly for a continuous casting machine.

Continuous casting machines are well known in the prior art and include a mold made up of two essentially parallel wide walls (broad face plates) and two essentially parallel narrow walls (narrow face plates) to define a casting passage of rectangular cross section. One of the narrow face plates is adjustable whereby the cross section of the mold, which determines the size of the slab to be cast in the mold, may be varied. The size of the continuous slabs formed by the continuous casting method is substantial as the slabs may be up to 12 inches thick and 100 inches wide. The mold is surrounded by a water jacket which cools the mold.

For a further description of continuous casting molds reference may be had to U.S. patent application Ser. No. 239,530 entitled THERMOCOUPLE FOR A CONTINUOUS CASTING MACHINE, which was filed on Sept. 1, 1988 and which is assigned to the assignee of record of the present application, which description is incorporated herein by reference.

The slab has a very thin skin when it initially forms in the mold. Due to the weakness of the thin skin, the slab must be supported even after it leaves the mold. For this purpose, a series of support zones is conventionally arranged downstream of the mold for continuously supporting the slab as it emerges from the mold. Various types of assemblies have been provided in the past for the support zones. One prior art assembly has provided shoes or grids to support the slab. Another prior art support structure has included a frame having rollers mounted therein wherein the entire frame was resiliently mounted by means of a spring to resiliently support the slab. In this arrangement, the individual rollers mounted in the frame were not spring loaded and the frame was hingedly secured to the continuous casting assembly.

It is important that such support assemblies are resiliently supported as the thickness of the slab may vary to some extent. Furthermore, by providing resilient supporting means, it is assured that the slab is continuously contacted by the support assemblies.

Still other prior art support structures have included individually spring biased rollers mounted to resiliently support the cooling slabs. Yet still other prior art structures have included pinch rollers between which a slab was pinched and wherein the rollers were driven at a predetermined rate to permit the slab to advance therebetween.

A disadvantage of all the above described support assemblies for supporting a continuous cast slab has been that they have been rather complicated and therefore costly to construct. Furthermore, the prior art structures have been difficult to adjust because of their complexity. These prior art structures have included many components each one of which had to be adjusted, thereby causing unnecessary expense in setting up of the casting assembly. Still others of these prior art structures have resulted in too much friction between the slab and the support structure, which is undesirable.

Thus there is a need for a support assembly for a continuous casting machine which is easy to adjust, which is relatively low in cost, and which is subject to little wear of the support structure so that repair of the support structure is required much less frequently than with the above described prior art devices.

SUMMARY OF THE INVENTION

The present invention, in one form thereof, overcomes the disadvantages of the above described prior art support structures by providing an improved support structure therefor. The support structure, according to the present invention, comprises a frame which is adjustably secured to the continuous casting mold. A plurality of rollers are resiliently mounted in the frame so that each of the rollers is individually spring biased to continuously provide resilient support for the slab. The entire frame may be moved toward or away from the slab and then secured in the adjusted position.

The present invention, in one form thereof, comprises a frame and an adjusting device mounted on the frame for adjustably securing the frame to the mold. A plurality of roll holders are mounted on the frame and a roller is rotatably mounted in each of the roll holders. At least one spring is mounted in each of the roll holders for resiliently urging each of the rollers toward the slab. The advantages of the footroll assembly according to the present invention is that the support assembly is easy to adjust because the entire frame is adjusted rather than each individual roller. Furthermore, each of the rollers are resiliently mounted in the frame so that any variation in the thickness of the slab will not cause uneven support by the individual rollers. The configuration therefore provides constant support for the slab. Due to the resilient supporting forces on the rollers, the rollers are subject to less wear and therefore maintenance of the support structure is less expensive as compared to the prior art support structures. Further, due to the simplicity of structure, the entire footroll assembly is relatively easy to repair.

It is an object of the present invention to provide a footroll assembly which is simple in construction and easy to adjust.

It is a further object of the present invention to provide a footroll assembly which provides constant support for the slab, regardless of variations in the width of the slab.

Still a further object of the present invention is to provide a footroll assembly which is not subject to excessive wear.

BRIEF DESCRIPTION OF THE DRAWINGS

The above mentioned and other features and objects of the invention and the manner of attaining them will become more apparent and the invention itself will be better understood by reference to the following description of an embodiment of the invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
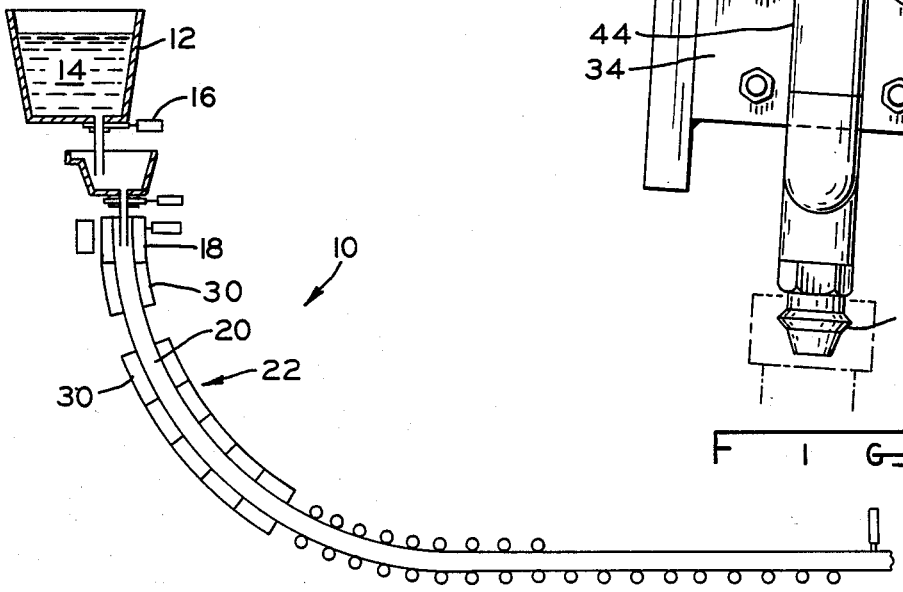
FIG. 1 is a diagrammatic elevational view of a continuous casting apparatus.

Referring to FIG. 1, there is shown a continuous casting apparatus 10 including a ladle 12 which contains molten metal 14. The molten metal is metered through a gate 16 into a mold 18. Mold 18 is at a lower temperature than molten steel 14. Typically the steel, in its molten state, will be at a temperature of approximately 2700° F. and mold 18 will be maintained at a temperature of approximately 500° F. by means of cooling water which flows through a water cooling jacket surrounding the mold. Thus, the external surface of the metal in mold 18 will form a skin whereas the center of the metal may still be molten. The solidified metal slab 20 will progress out of mold 18 and will be supported by a roller apron 22 which bends the slab 20 as it cools and guides the slab to a position where the slab is cut into sections (not shown). A pair of footroll assemblies 30 is shown, secured to the bottom of mold 18, for guiding the slab during its initial travel out of the mold.

Figure 4:
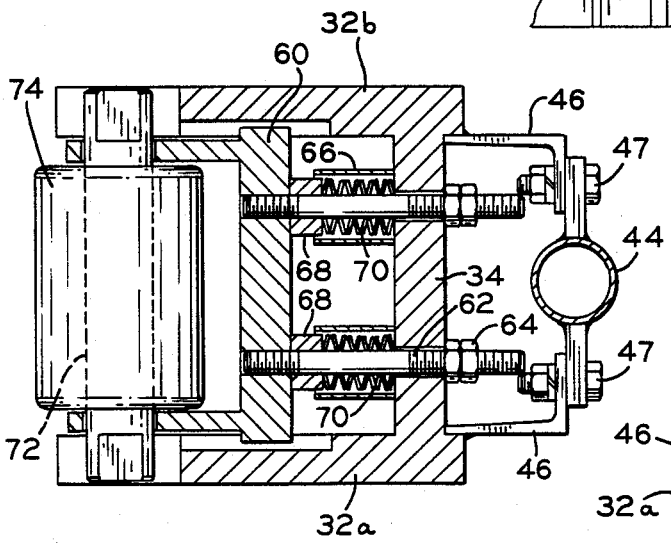
FIG. 4 is a cross sectional view of the footroll assembly of FIG. 2 taken along line 4—4 thereof.
Figure 2:
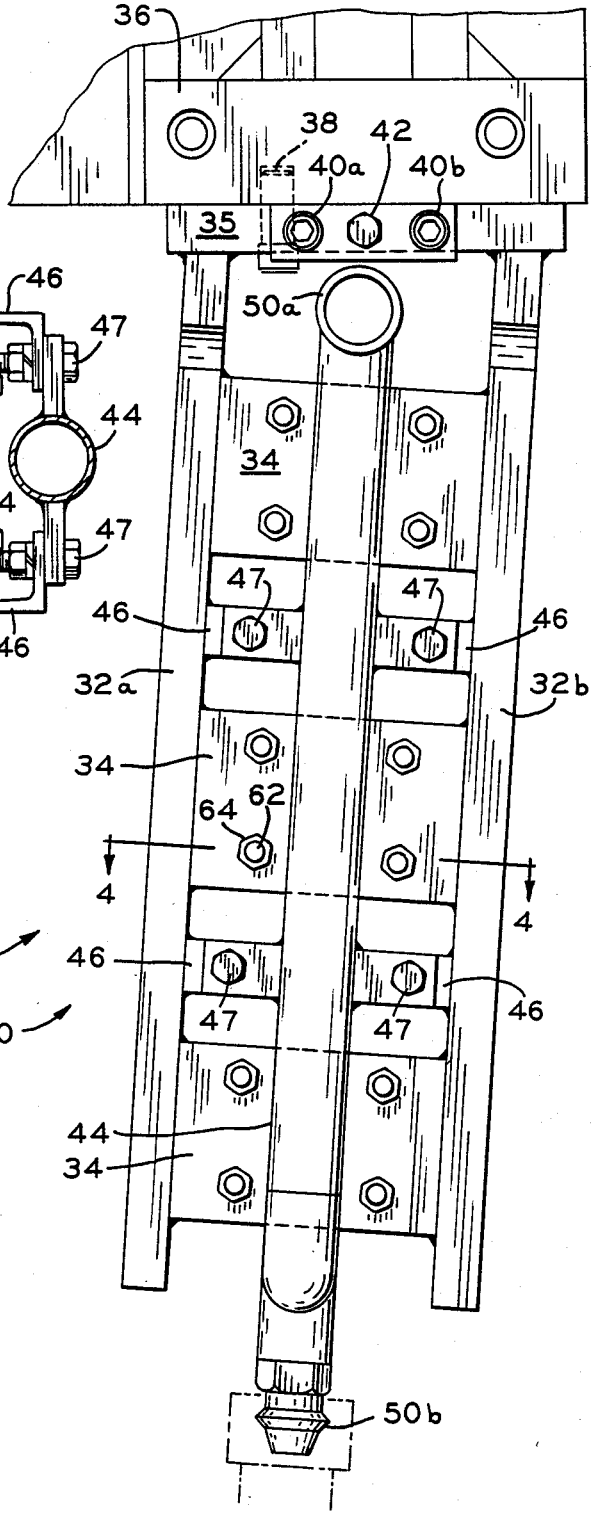
FIG. 2 is an elevational view of a footroll assembly secured to a continuous casting mold.
Figure 3:
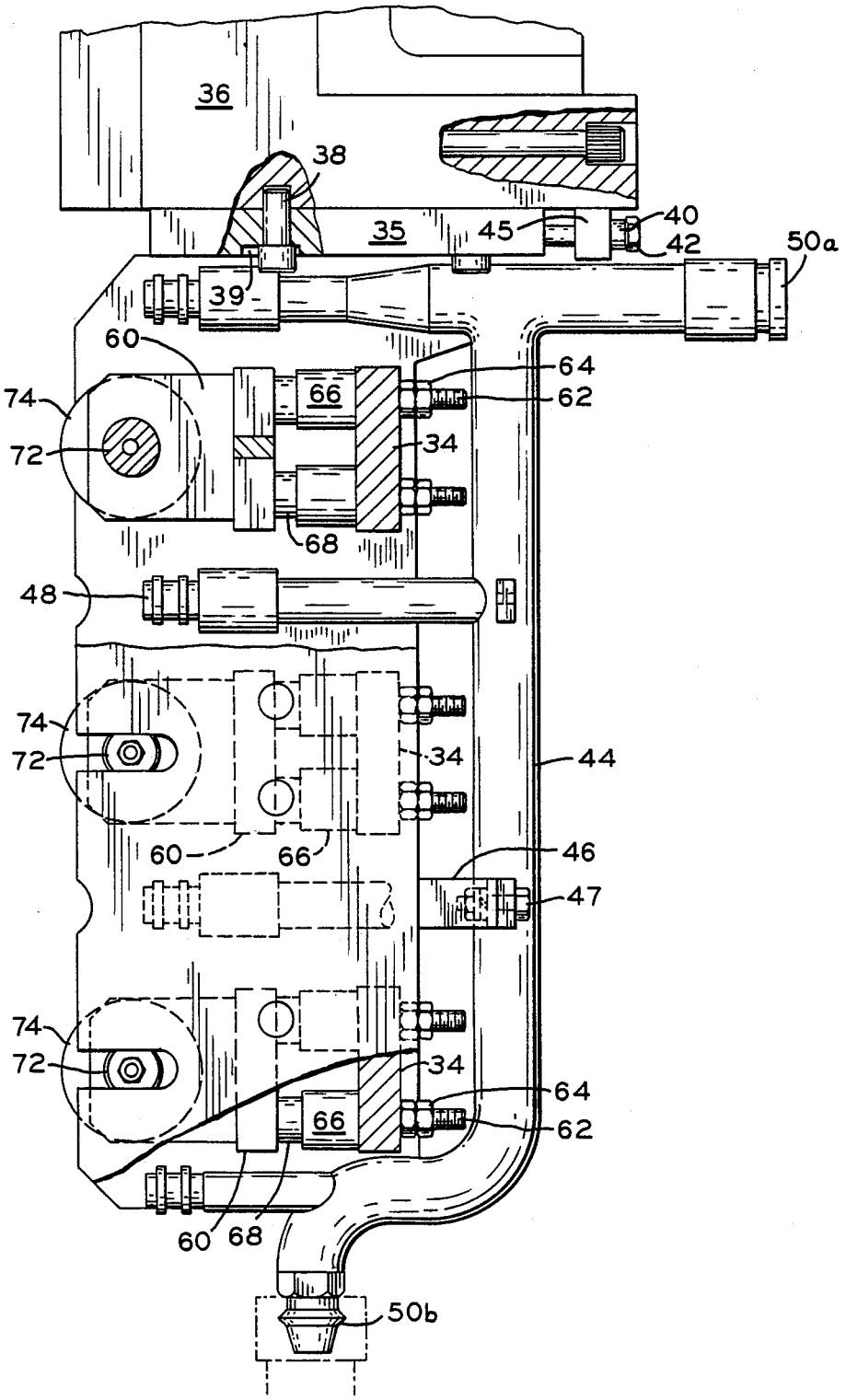
FIG. 3 is a side elevational view of the footroll assembly of FIG. 2.

Turning now to FIGS. 2–4, one of the footroll assemblies 30 is shown. The footroll assembly includes a frame 31 having side supports 32*a* and 32*b*. The side supports are interconnected by means of three brackets 34. At the top of the frame is a support bracket 35. Frame 31 is secured to the narrow side backup frame 36 of the mold by means of bolts 38 which secure bracket 35 as shown. Support bracket 35 also includes two bolts 40 and a single bolt 42. These bolts 40, 42 function, by means of a portion 45 of the narrow side back up frame, to permit adjustment of the entire frame 31 to the right or to the left as shown in FIG. 3. Bolt 42, when turned clockwise, pushes support bracket 35, and therefore entire frame 31, to the left. Bolts 40, when turned clockwise, will draw bracket 35 to the right. Bracket 35 is able to move, when bolts 38 are loosened, because the countersink 39 in bracket 35 is much larger than the head of bolts 38. After adjustment of bolts 40 and 42, bolts 38 are tightened whereby frame 35 will now be rigidly held in its adjusted position.

A spray header 44 is secured to a spray header support frame 46 by means of bolt 47. Spray header 44 includes spray nozzles 48 which spray cooling water on the slab as it passes by the footroll assembly, thereby cooling the slab further. Spray header 44 also includes two couplings 50*a* and 50*b* for connection to the water supply of the spray header system.

Frame 31 has three roll holders 60 secured thereto as best seen in FIG. 3. Each roll holder 60 is bolted to a bracket 34 by means of four bolts 62 which are secured to bracket 34 by means of nuts 64. Brackets 34 also include four spring cups 66 as best seen in FIG. 4. Roll holders 60 include four cylindrically shaped spring stops 68 which surround bolts 62. Each of cups 66 has disk springs 70 mounted therein, sometimes referred to as Belleville springs, which are captured in the cup and which surround bolts 62. By reference to FIG. 4, it can be seen that by adjusting nuts 64 on bolts 62, disk springs 70 can be placed under a predetermined amount of compression. Roll holder 60 is U-shaped to form a yoke with a roller shaft 72 held at the end of the yoke. A roller 74 is rotatably supported by shaft 72.

It should be noted that instead of the use of disk springs for the resilient mounting of the individual rollers, various types of spring mountings could be used.

In operation, the footroll assemblies 30 are adjusted so that the amount of space between the footroll assemblies mounted on either side of a slab is sufficient for a slab to pass therebetween. Adjustment is made by means of bolts 40 and 42. Since the entire frame 31 is adjustable, adjustment of the footroll assembly 30 is much more simple than adjustment of prior art footroll assemblies. Rather than adjusting each individual roller, the entire footroll assembly may be easily adjusted. Furthermore, since each of the individual rollers is resiliently mounted, variations in the thickness of a slab will be accommodated by the resilient mounting of the individual rollers.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

We claim:

1. In a continuous casting machine including a mold, a footroll assembly for guiding a slab cast in said mold, said assembly comprising:

a frame;

adjusting mean for adjustably securing said frame to said mold, said frame being adjustable toward and away from a slab cast in said mold;

a plurality of rollers mounted on said frame, said rollers adapted to support and guide a slab from said mold;

at least one spring means associated with each of said rollers whereby said rollers resiliently support said slab.

2. The footroll assembly according to claim 1 wherein said adjusting means comprises a means for moving said entire frame toward and away from said slab and means for securing said frame in an adjusted position.

3. The footroll assembly according to claim 2 wherein said means for moving comprises at least two threaded fasteners.

4. The footroll assembly according to claim 1 wherein said spring means comprises a disk washer spring.

5. The footroll assembly according to claim 1 wherein said spring means includes means for placing said spring under a predetermined amount of compression.

6. A footroll assembly for a continuous casting machine including a mold, said assembly comprising:

a frame;

means connected to said frame for adjustably securing said frame to a mold in which a slab is cast, said entire frame being movable toward and away from said slab;

a plurality of roll holders mounted on said frame; and a roller resiliently mounted in each said roll holder for resiliently contacting said slab.

7. The footroll assembly according to claim 6 wherein said means for adjustably securing includes at least two first threaded fasteners to respectively move said frame toward or away from said slab and a plurality of second threaded fasteners to secure said frame in an adjusted position.

8. The footroll assembly according to claim 6 including a plurality of springs for respectively resiliently mounting each said rollers.

9. The footroll assembly according to claim 8 wherein said springs comprise disk springs.

10. The footroll assembly according to claim 8 including means for placing said spring under a predetermined amount of compression.

11. The footroll assembly according to claim 6 wherein said roll holder comprises a yoke for supporting a shaft, said shaft rotatably receiving a roller, fastening means for securing said yoke to said frame and a compression spring mounted between said frame and yoke for urging said yoke away from said frame.

12. A footroll assembly for a continuous casting machine which includes a mold for continuously casting metal slabs, said assembly comprising:

a frame for supporting a plurality of rollers;

adjusting means mounted on said frame for adjustably securing said frame to said mold;

a plurality of roll holders mounted on said frame;

a roller rotatably mounted in each said roll holder; and a spring mounted in each said roll holder for resiliently urging each said roller toward a said slab.

13. The footroll assembly according to claim 12 wherein said adjusting means comprises a means for moving said entire frame toward or away from said slab and means for securing said frame in an adjusted position.

14. The footroll assembly according to claim 12 wherein said spring comprises a disk spring.

15. The footroll assembly according to claim 12 including means for placing said spring under a predetermined amount of compression.

16. The footroll assembly according to claim 12 wherein said roll holder comprises a yoke for supporting a shaft, said shaft rotatably receiving a said roller, fastening means for securing said yoke to said frame, and means for mounting said spring between said frame and yoke for urging said yoke away from said frame.

* * * * *